US006108858A

United States Patent [19]

Smith

[11] Patent Number: 6,108,858

[45] Date of Patent: Aug. 29, 2000

[54] WASTE RECEPTACLE FOR A VACUUM CLEANING SYSTEM

[75] Inventor: James N. Smith, Winnipeg, Canada

[73] Assignee: Canplas Industries Ltd., Barrie, Canada

[21] Appl. No.: 09/090,845

[22] Filed: Jun. 4, 1998

[51] Int. Cl.[7] ..... A47L 5/38

[52] U.S. Cl. ..... 15/314; 15/301

[58] Field of Search ..... 15/301, 310, 314

[56] References Cited

U.S. PATENT DOCUMENTS

| | | | |
|---|---|---|---|
| 3,027,587 | 4/1962 | Bierstock | 15/301 |
| 3,027,588 | 4/1962 | Bierstock | 15/301 |
| 3,655,927 | 4/1972 | Samuelson et al. | 15/314 |
| 5,083,704 | 1/1992 | Rounthwaite | 15/314 |
| 5,205,013 | 4/1993 | Lopes | 15/301 |
| 5,279,016 | 1/1994 | Klassen | 15/301 |
| 5,408,721 | 4/1995 | Wall et al. | 15/301 |
| 5,504,967 | 4/1996 | Graham | 15/301 |

FOREIGN PATENT DOCUMENTS

| | | |
|---|---|---|
| 675552 | 12/1963 | Canada . |
| 2105554 | 3/1995 | Canada . |

*Primary Examiner*—Theresa T. Snider

[57] ABSTRACT

A floor mounted sweeping suction inlet is provided with a door that carries a user-activated portion by which the door may be opened by contact from a foot. This makes it unnecessary for the householder to bend over to activate the vacuum-operated waste collection system. The vacuum source can be turned-on automatically by opening the door by the presence of a door-activated electrical switch. An adapter converts the floor-mounted vacuum opening to a standard circular opening for receiving a vacuum hose and wand.

15 Claims, 10 Drawing Sheets

WASTE RECEPTACLE FOR A VACUUM CLEANING SYSTEM

FIELD OF THE INVENTION

This invention relates to vacuum collection systems for the disposal of waste. More particularly, it relates to a receptacle by which waste may be delivered into a household-type central vacuum cleaning system, or a portable vacuum cleaner that is in storage, by sweeping the waste into a floor-mounted inlet.

BACKGROUND TO THE INVENTION

Many houses today are equipped with central vacuum cleaning systems. Such systems operate on the basis of a suction apparatus installed in a remote location within the house, and a network of air-tight pipes that connect with various rooms in the house. These pipes terminate in individual, wall-mounted, inlets to which suction hoses are connected.

A convenience of such central vacuum cleaning systems is that a user need not carry a stand-alone vacuum cleaner from room to room. Rather, only the hose and an associated wand need be carried to the location to be cleaned. Nevertheless, even the act of fetching such hose and wand can be an inconvenience.

Prior art patents such as U.S. Pat. Nos. 3,027,587 and 3,027,588 to Bierstock, U.S. Pat. No. 5,408,721 to Wall, U.S. Pat. No. 5,279,016 to Klassen, U.S. Pat. No. 5,504,967 to Graham, and the present applicant's own earlier Canadian application 2,105,554, laid-open on Mar. 4, 1995 all disclose vacuum inlets in the form of a floor-mounted receptacle through which trash may be swept for delivery to a vacuum cleaning suction source.

The present invention addresses the need for a floor-mounted vacuum inlet or sweeping suction inlet of an improved design that can be connected to a central vacuum cleaning suction source. In particular, this invention relates to a receptacle for receiving waste that does not entail the transport of the normal hose and wand tools to the site being cleaned.

A further aspect of this invention provides for an arrangement whereby the floor-mounted vacuum inlet may accommodate and operate a traditional flexible vacuum hose with a suction wand.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to the invention a floor-mounted waste receptacle for a suction-based vacuum cleaning system is provided with a sealing outer door and an electrical switch assembly where the user-activating portion of the electrical switch assembly is carried by the door itself. More particularly, the door is provided with an activation flange extending along its length for ready opening and closing of such door.

The waste receptacle of the invention is intended to be located at floor level, preferably installed beneath an existing household fixture, such as a kitchen counter. Its mechanical dimensions also allow it to fit within a wall framed with four inch (nominal) studs. By reason of this location, the activation system of the invention provides special convenience to users by reason of the fact that it may be foot activated.

The waste receptacle has a waste transfer chamber that is elevated above the plane of the floor to provide space for a vacuum conduit coupling located on its lower side. A conduit coupling is preferably also provided on the upper side of the receptacle. With an enlarged receptacle an option for further multiple vacuum outlets may also be included. A ramped surface rises from the floor level forward edge of the suction inlet to merge with the elevated lower surface of the transfer chamber.

Upon opening of the door, the vacuuming action of the vacuum collecting system is automatically initiated by means of a door-activated switch associated with such door which switches the vacuum suction source "on" when the door is opened. Closure of the door shuts the vacuum source "off".

In one application of the invention, the vacuum cleaning suction source is located at a fixed, central place within the building housing the system. In another application of the invention, the vacuum suction source may be provided by a portable vacuum cleaner that is stored in a location where it is electrically and pneumatically coupled to provide the vacuum suction upon which the invention relies.

A further feature of the invention is the inclusion of a coupling means to convert the floor-mounted opening of the receptacle to a circular orifice that is angled upwards for engagement with a flexible vacuum hose that can terminate in a suction wand. More particularly, this adaptive coupling engages with, and seals against, the opening in the receptacle by being positioned between:

(1) a lower, horizontal dust-receiving ramp extending along the lower edge of the suction inlet opening in the receptacle; and (2) the receptacle door in its opened position.

The angled shape and position of the door as established by the activation flange serve to locate and retain the coupling in place. The retention of the coupling in place is further assisted by the lower pressure condition developed therein upon activation of the vacuum suction mechanism.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
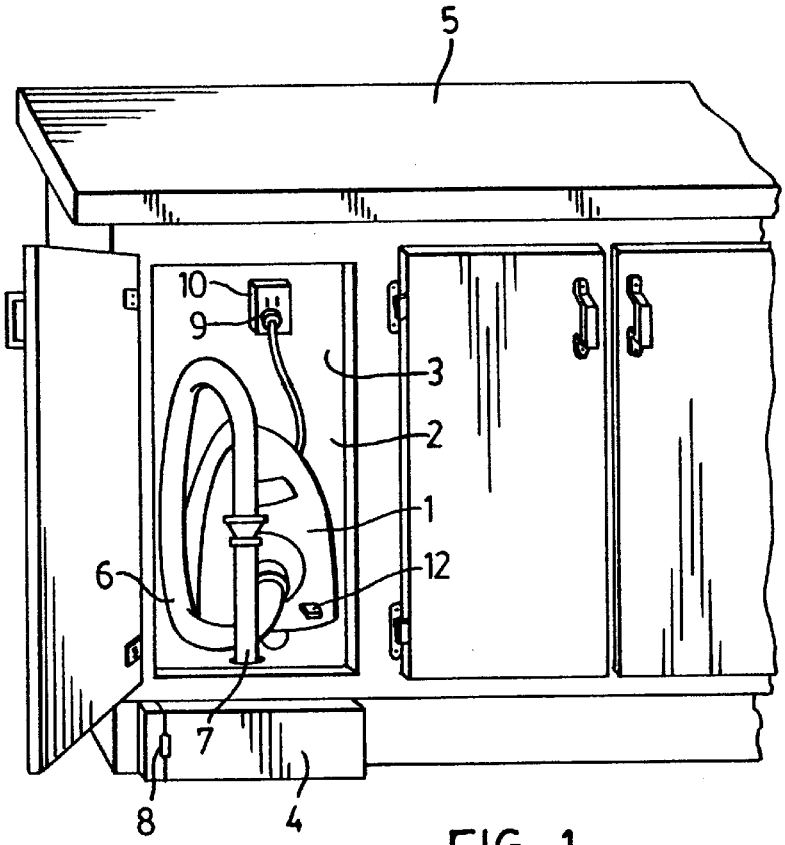
FIG. 1 (PRIOR ART)
FIG. 1 a pictorial view of a prior art arrangement of a portable vacuum cleaner stored in a kitchen cupboard and connected electrically and pneumatically to serve as the suction source for a floor-mounted vacuum receptacle.

In FIG. 1 a prior art system utilizes a standard portable vacuum cleaner unit 1 as the suction source 2. Conveniently, this unit is stored in a storage compartment or cabinet 3 proximate to the waste receiving receptacle 4 as, for example, beneath a counter 5. It is stored with its normal hose 6 connected to a pipe 7 leading through ducting to the waste receptacle 4. It is also stored with its electrical plug 9 engaged in a power outlet 10 controlled by the power switch 8. Lastly, it is stored with its own switch 12 positioned at "on".

In this manner, the normal household vacuum cleaner 1, while in storage, will serve to operate the waste receptacle outlet in the same manner as a central vacuuming system. The advantage of the embodiment of FIG. 1 is that it can readily be installed for less cost than a central vacuuming system.

Figure 2:
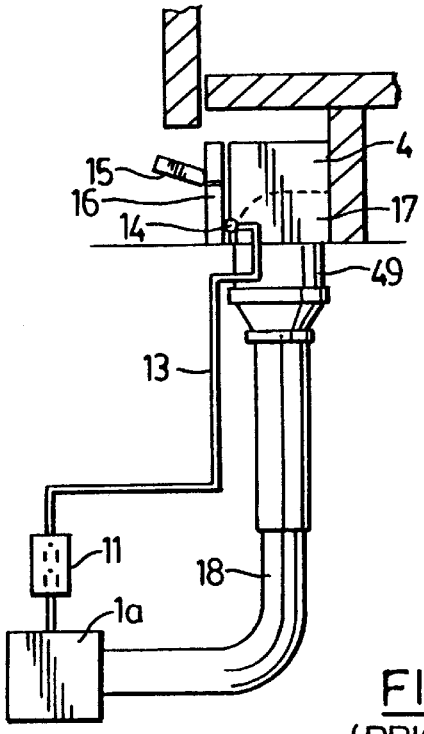
FIG. 2 (PRIOR ART)
FIG. 2 is a schematic profile view of a prior art arrangement for a floor-mounted vacuum receptacle connected to a central vacuum suction source through a coupling and conduits that extend downwardly from the receptacle, including the wiring that may be used to automatically activate on the vacuum system when the door to the receptacle opens.

FIG. 2 shows another prior art arrangement with a waste receptacle 4 connected to a central vacuum suction source 1*a*. That source la is provided with electrical energy from a relay-controlled outlet 11.

In FIG. 2, the supply of electricity from the outlet 11 to the vacuum suction source 1*a* is controlled through wires 13 leading to the power switch 11. A low voltage switch activated by the door 15 on the receptacle 4 controls the electrical power outlet 11. With the door 15 open and the suction source 1*a* operating, an air flow through the entrance opening 16 of the receptacle 4 carries waste through a sealed transfer chamber 17 to an outlet 49 that is coupled to ducting 18. This ducting 18 connects to the suction source 1*a*.

Figure 3:
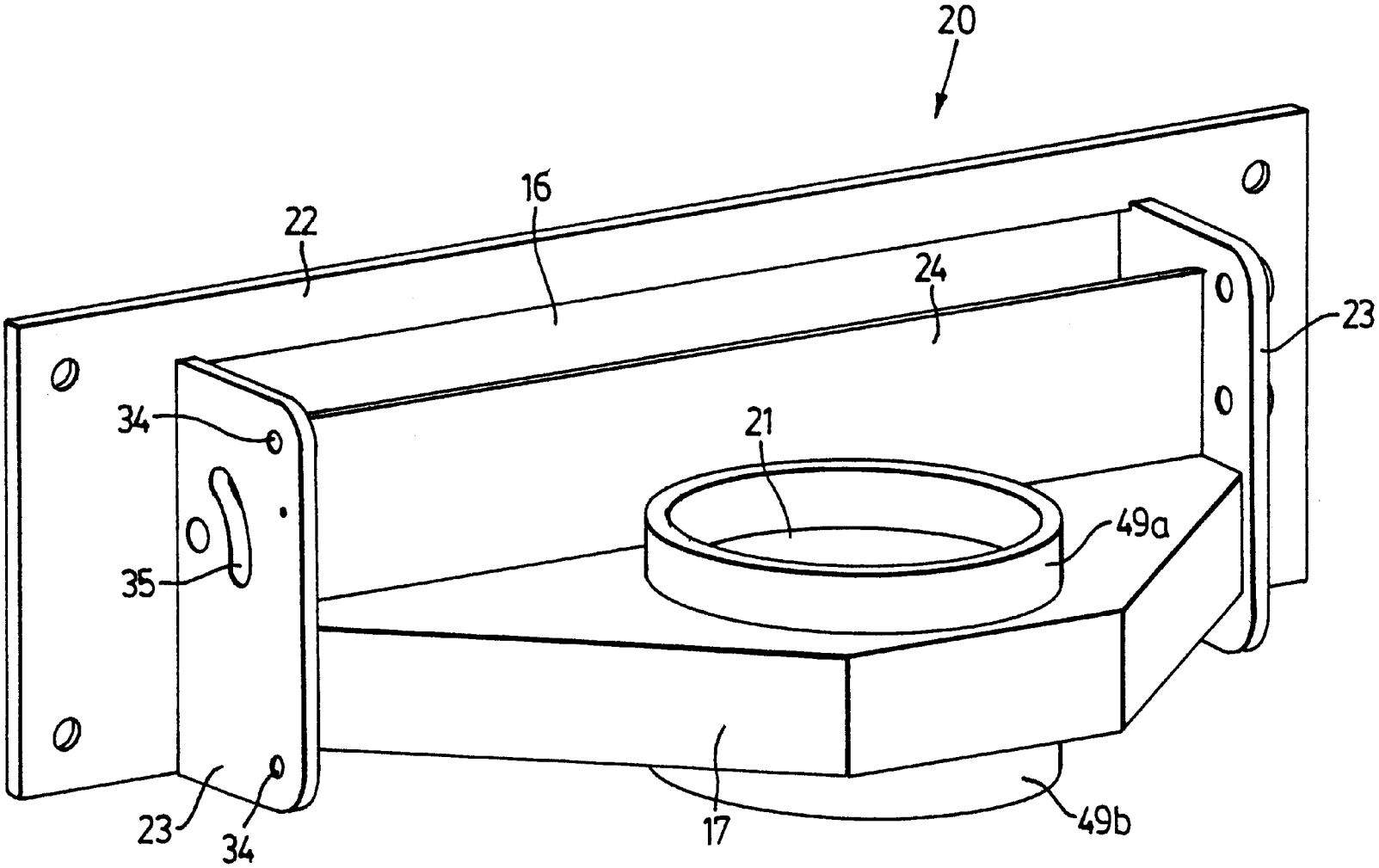
FIG. 3 is a rear perspective, upper quadrant, view of the receptacle of the invention with the door and switch hardware removed.
Figure 4:
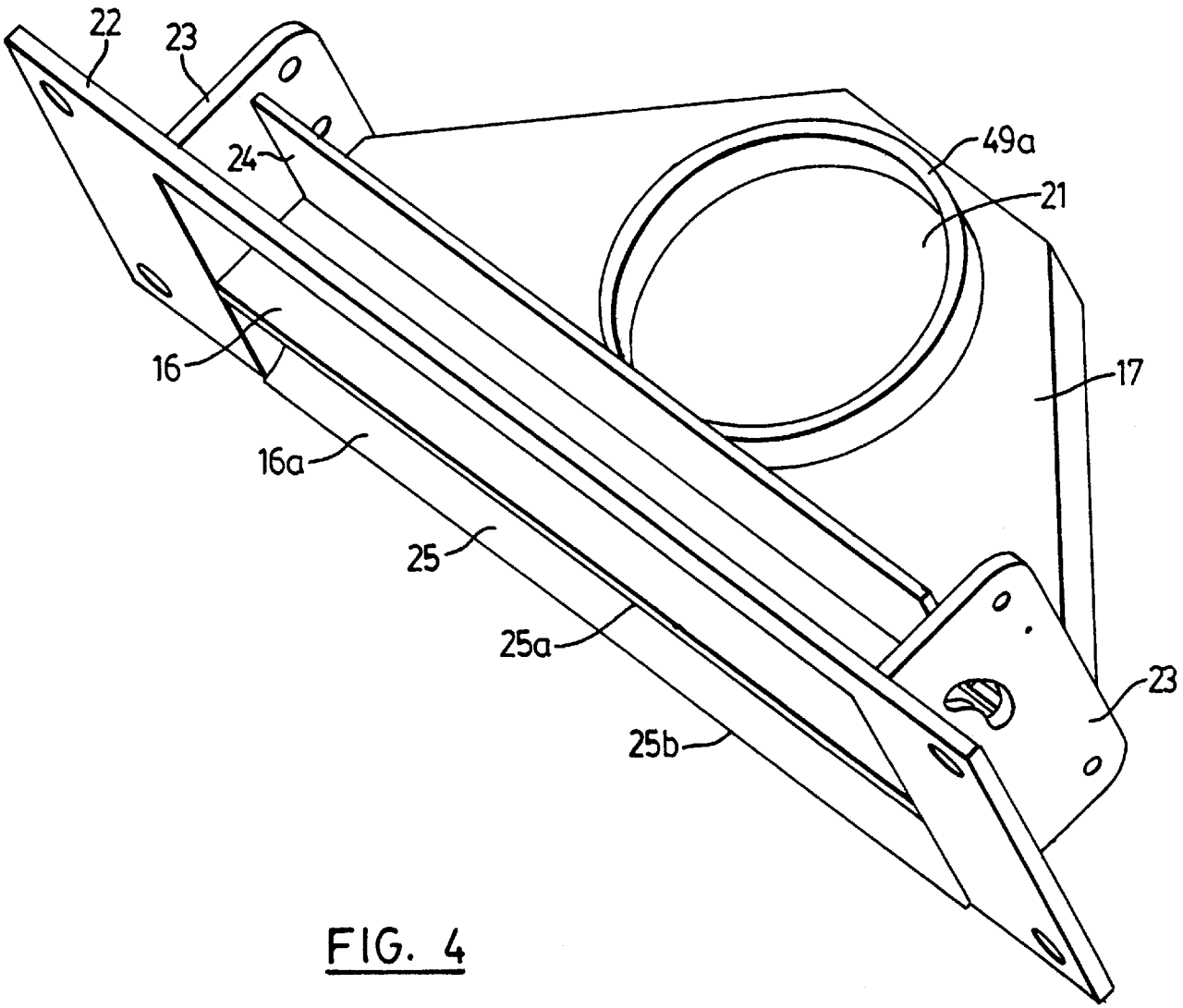
FIG. 4 is a front, upper quadrant, perspective view of the receptacle of FIG. 3.

In FIGS. 3 and 4 the body of the waste receptacle 20 of the invention is shown without its door 26 attached. A transfer chamber 17 has upper 49*a* and lower outlets 49*b* for coupling to ducting. The receptacle is sold with sealing knock-out discs 21 closing the outlets 49*a*, 49*b*. At the job site one disc 21 is removed, depending on which outlet 49*a*, 49*b* is selected for coupling to the ducting 18.

The transfer chamber 17 carries a front plate 22 supported through main flanges 23. A stiffening plate 24 strengthens the flanges 23. The stiffening plate 24 also partially blocks the entrance opening 16 formed in the front plate 22.

In FIG. 4 it will be seen that the top 25*a* and bottom 25*b* front edges of the transfer chamber 17 terminate at the plane of the front plate opening 16. This defines a suction inlet portion 16*a* within the opening 16.

The bottom edge 25*b* of the suction inlet portion 16*a* has a bevelled ramp 25 terminating in line with the bottom plane of the receptacle 4. When mounted, this ramp 25 ends at its outer edge in alignment with the floor. The ramp 25 may protrude slightly beyond the front plane of the front plate 22 and extends inwardly and upwardly to terminate along its inner edge at the bottom panel of the transfer chamber 17, above the plane of the floor. This allows the lower outlet 49*a* to extend downwardly from a position that starts above the plane of the floor.

Figure 5:
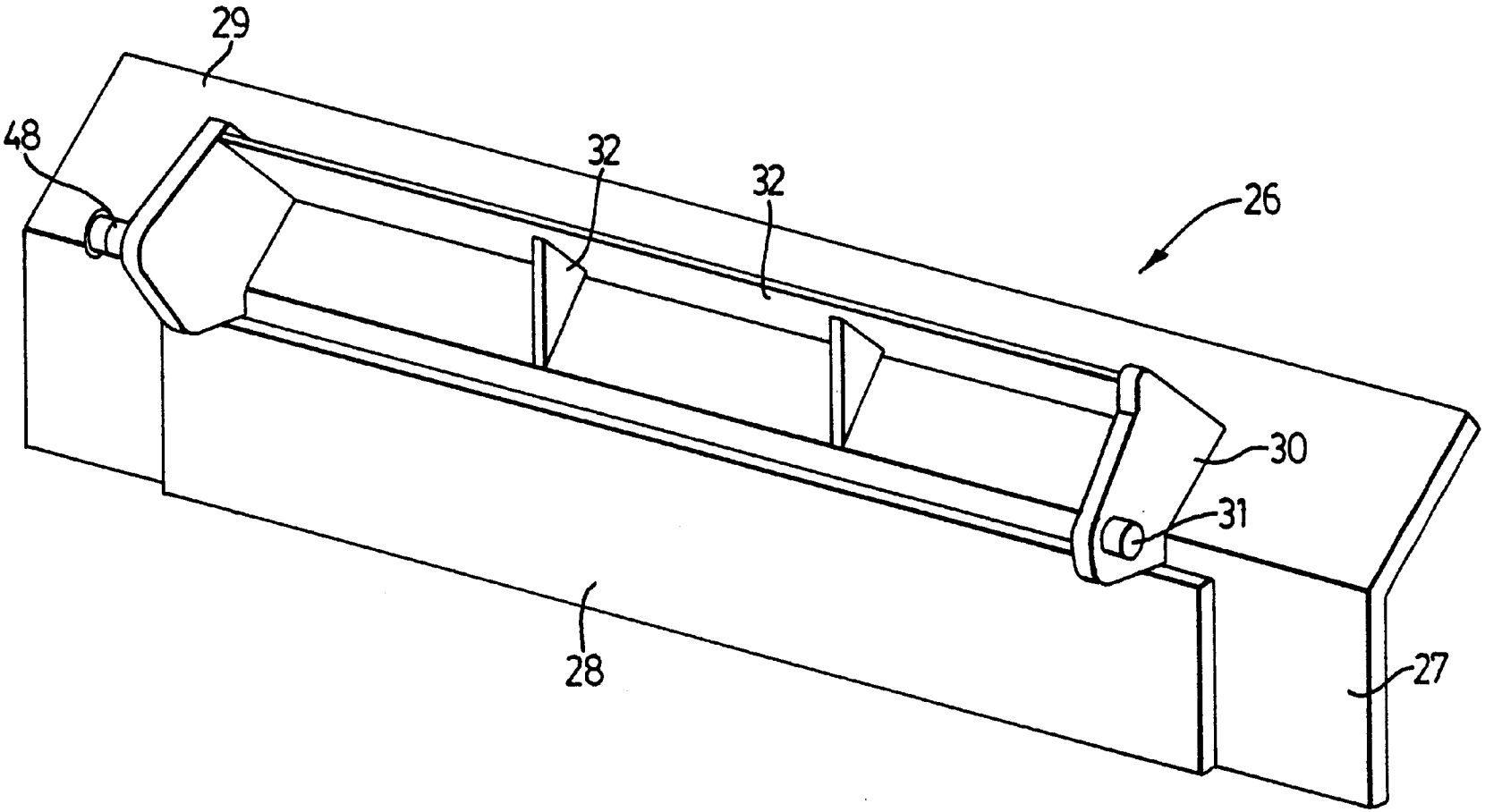
FIG. 5 is a rear perspective view of the door with gasket intended for mounting on the receptacle of FIG. 2.

A door 26 shown separately in FIG. 5 has a flat closure plate portion 27 which carries a gasket 28 for sealing against the suction inlet 16*a*. An angled flange 29 extends above the closure plate portion 27, protruding outwardly. Hinge support flanges 30 carry a pair of hinge pins 31 (only one being shown in FIG. 5) and reinforcing plates 32 stiffen these hinge flanges 30.

Figure 6:
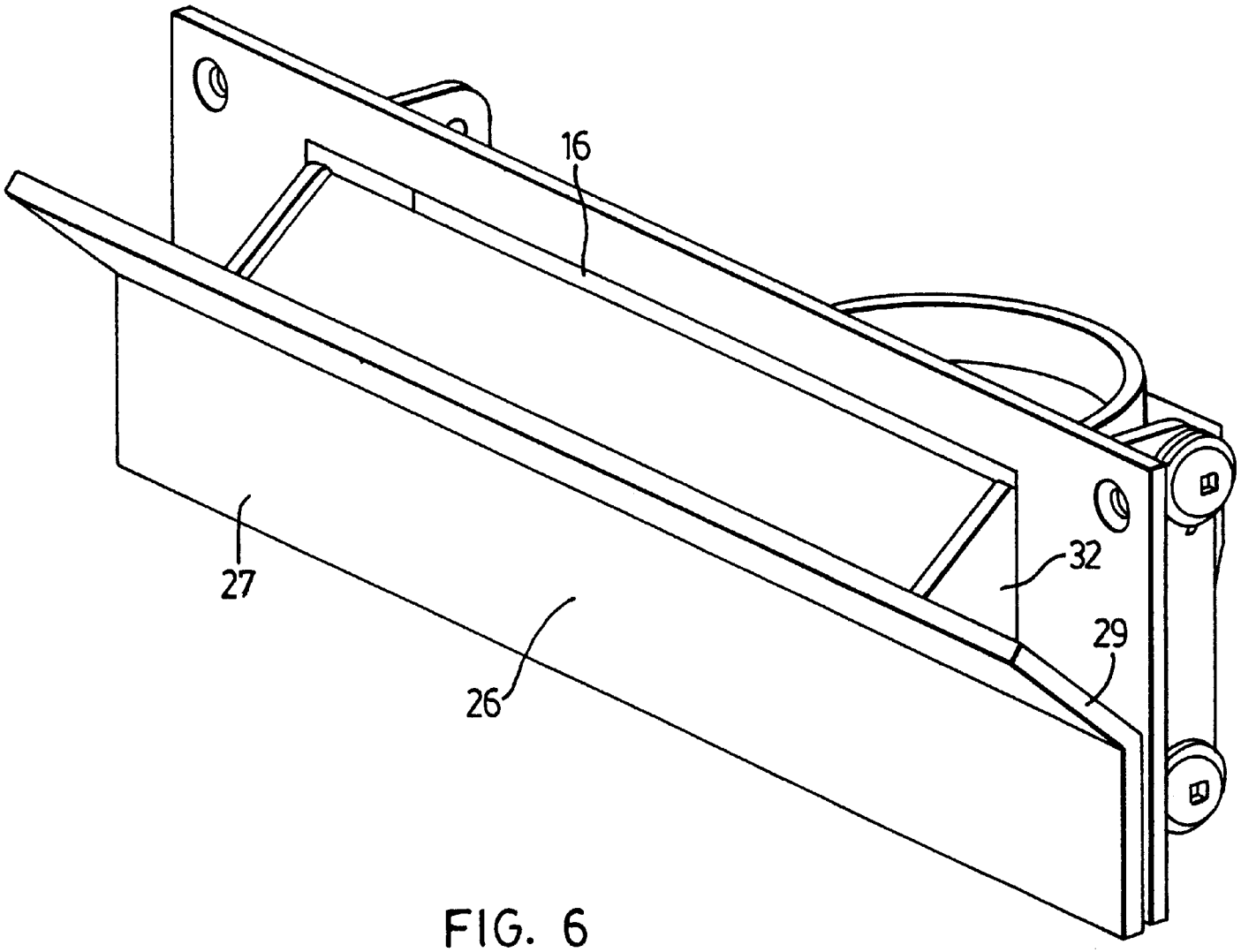
FIG. 6 is a front perspective view of the receptacle of FIG. 3, with the door of FIG. 5 mounted thereon in closed position and electrical hardware installed.

The door 26 is mounted over the suction inlet opening 16*a* as shown in FIG. 6 with the reinforcing plates 32 extending through the portion of the opening 16 above the suction inlet 16*a*. The angled flange 29, with the door 26 closed, is forwardly and outwardly inclined.

Figure 7:
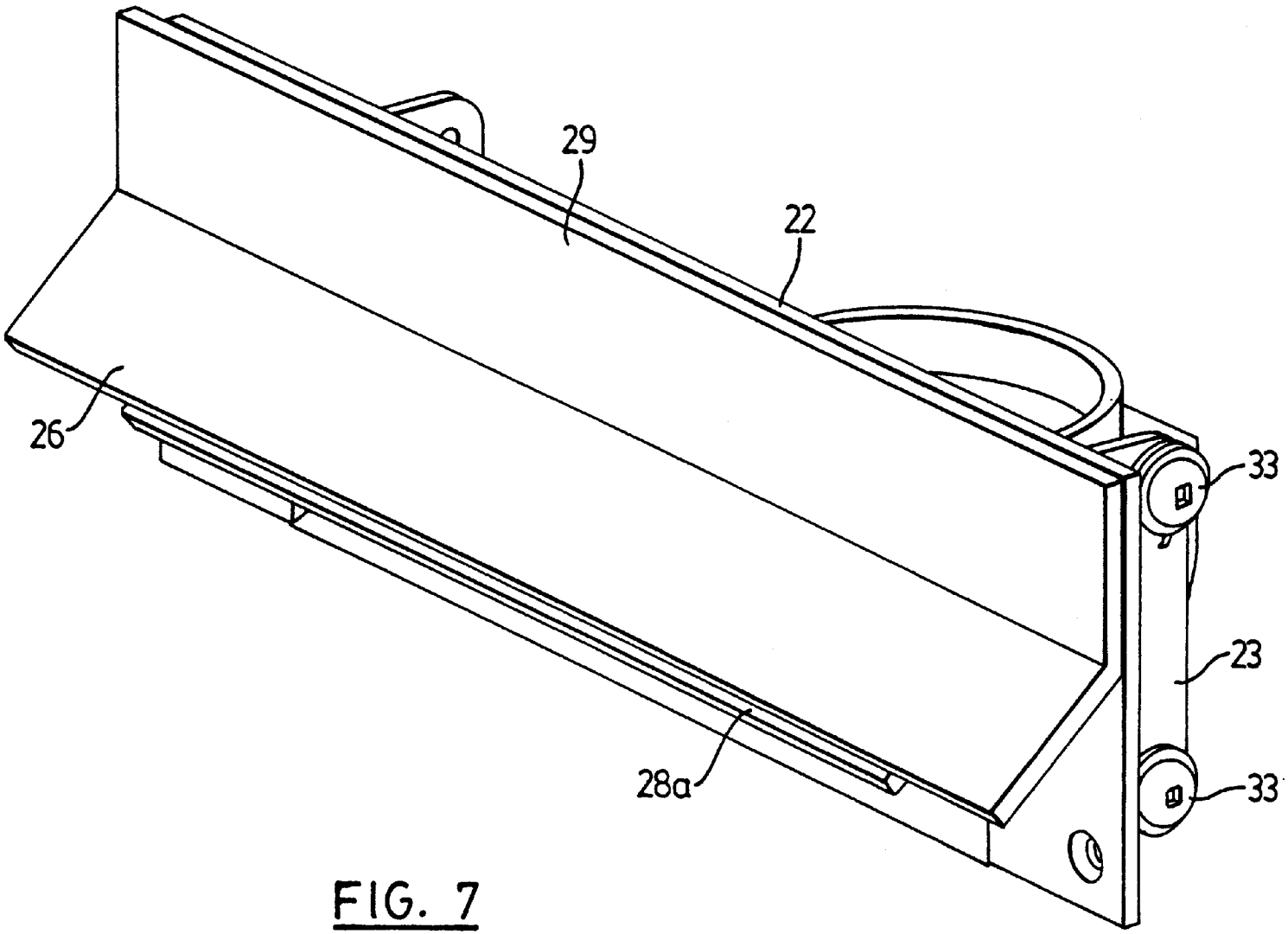
FIG. 7 is a perspective view of the receptacle of FIG. 6 with the door in open position.

With the door 26 open, as shown in FIG. 7, the upper angled flange 29 on the door 26 bears against the front plate 22 with the gasket 28 just overlying, or contacting, the protruding portion of the ramp 25. A small protrusion 28*a* of the gasket 28 along the lower edge of the door 26 assists in effecting a vacuum seal.

Figure 8:
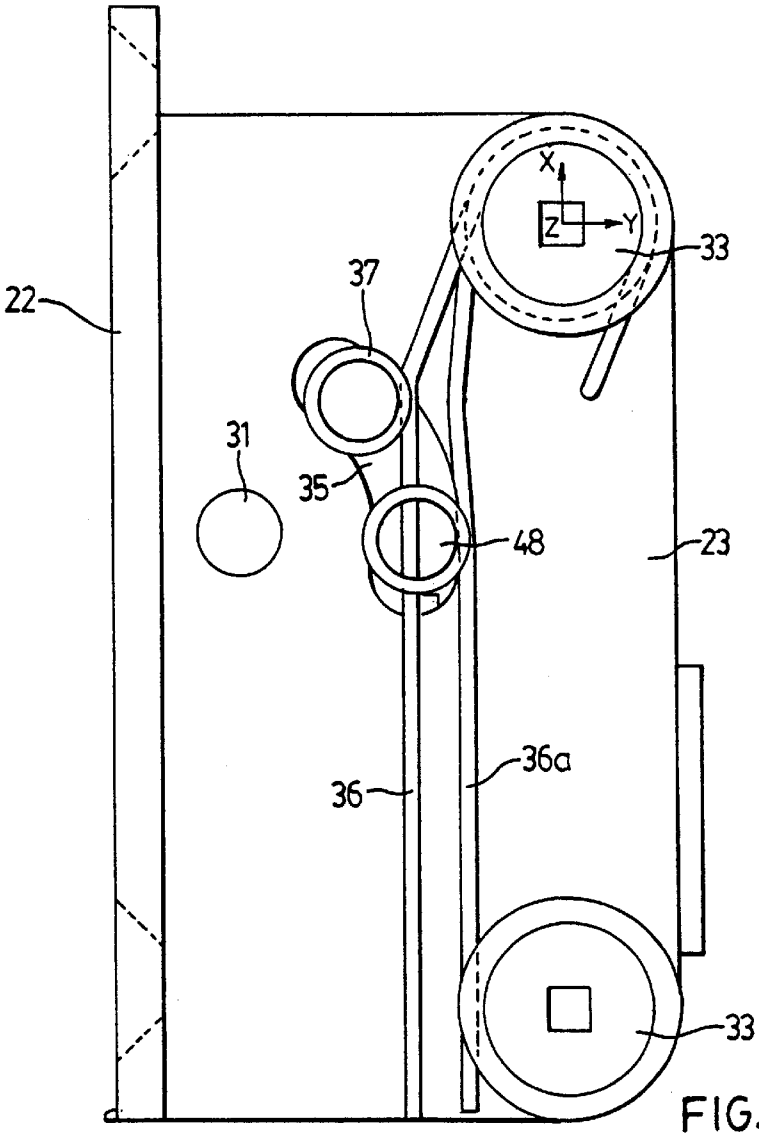
FIG. 8 is a side view of the details of the electrical hardware on the receptacle of FIG. 6 in two, "off" and "on", positions.
Figure 9:
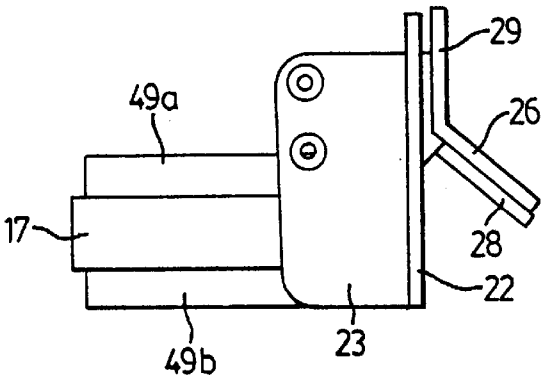
FIG. 9 is a side view of the receptacle of FIG. 6 taken from the side opposite the electrical hardware with the door in an open position.

On one main flange 23 two electrical contacts 33 are mounted through circular holes 34 (FIG. 3). A further switch activating pin 48 extends through an arcuate hole 35 in this main flange 23. A spring 36 is fastened on one of the electrical contacts 33 extending past the switch activating pin 48 to lie adjacent the second electrical contact 33. Upon opening the door 26, the switch activating pin 48 in the slot 35 travels in an arcuate path pressing the spring 36 against the second electrical contact 33 to lie in a position 36*a*. This serves to close a low voltage circuit provided through wires (not shown in FIG. 8 but see wires 13 in FIG. 2) connected to the electrical outlet 11 to activate the suction source 1, 1*a*. A brass rim 37 may be mounted on the switch activating pin 48 to reduce wear.

FIGS. 9, 10, 11 and 12 show a receptacle 4 with the door 26 open.

Figure 13:
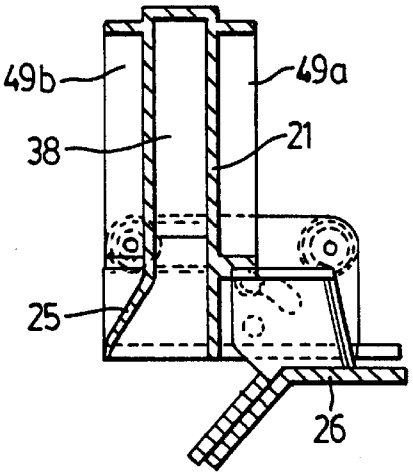
FIG. 13 is the side cross-sectional view taken through FIG. 11.
Figure 10:
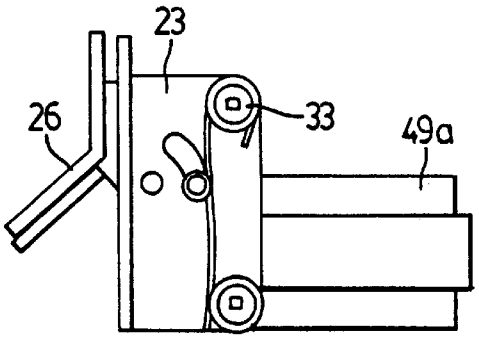
FIG. 10 is a side view of the receptacle of FIG. 6 taken from the side of the electrical hardware with the door in an open position.
Figure 11:
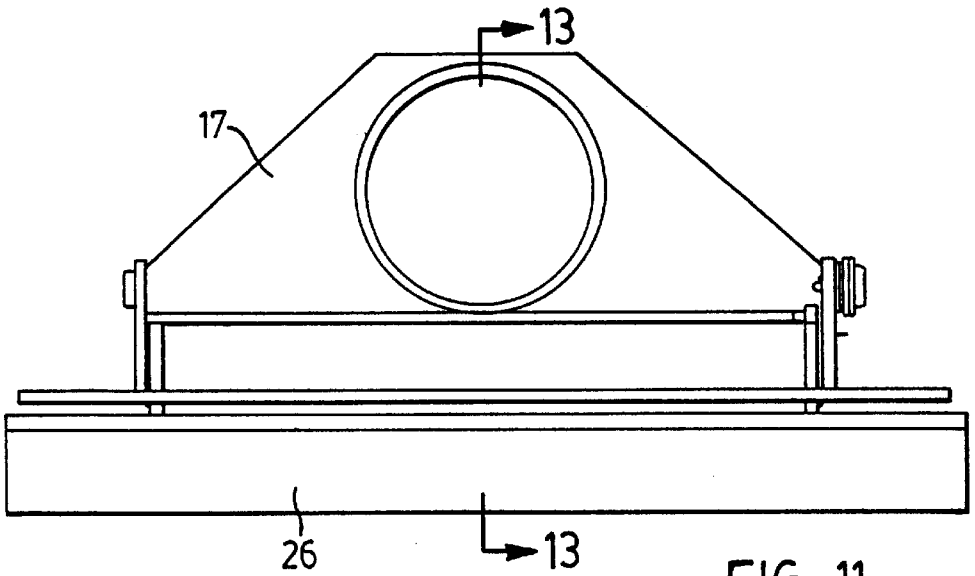
FIG. 11 is a top view of the receptacle of FIG. 6 with the door closed showing the direction of the cross-sectional view of FIG. 13.
Figure 12:
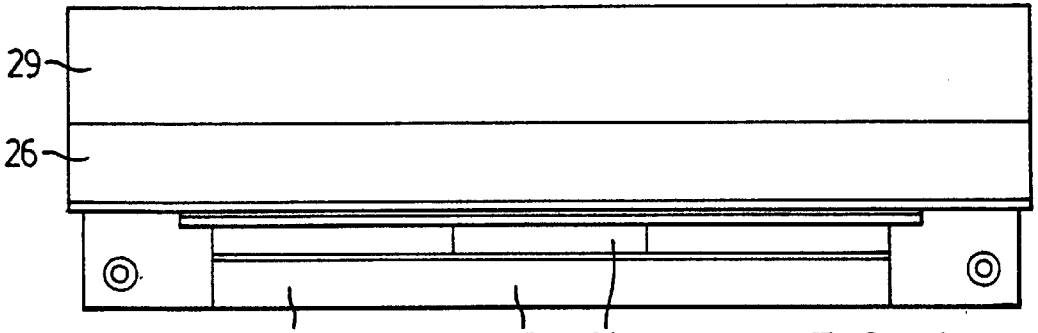
FIG. 12 is a front view of FIG. 11.

FIG. 13 is a cross-sectional view taken through FIG. 11 the shows the inner space 38 of the transfer chamber 17. Also shown is the ramp 25. The portion of the ramp 25 adjacent to the vacuum suction inlet 16*a* preferably has a concave curvature relative to the suction inlet 16*a*.

Figure 14:
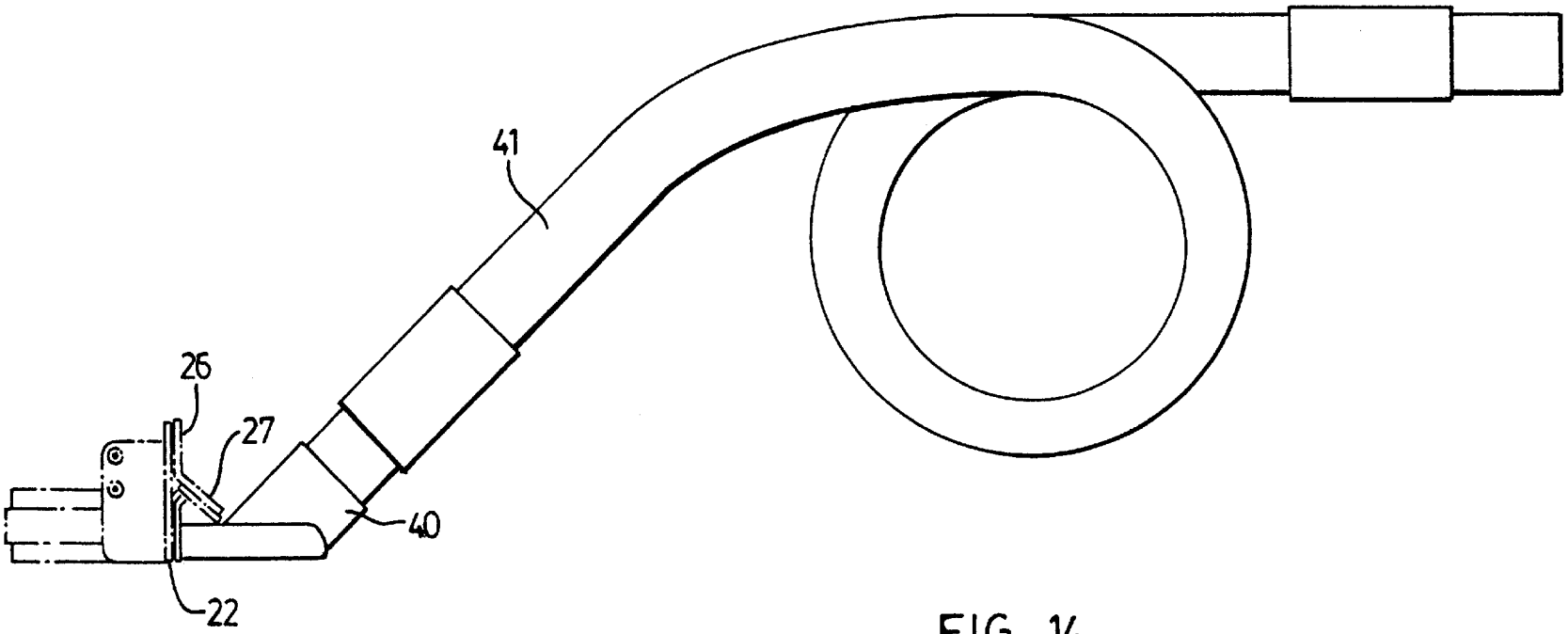
FIG. 14 is a side view of the receptacle in ghost outline with a hose coupling positioned beneath the door and a hose attached thereto.
Figure 18:
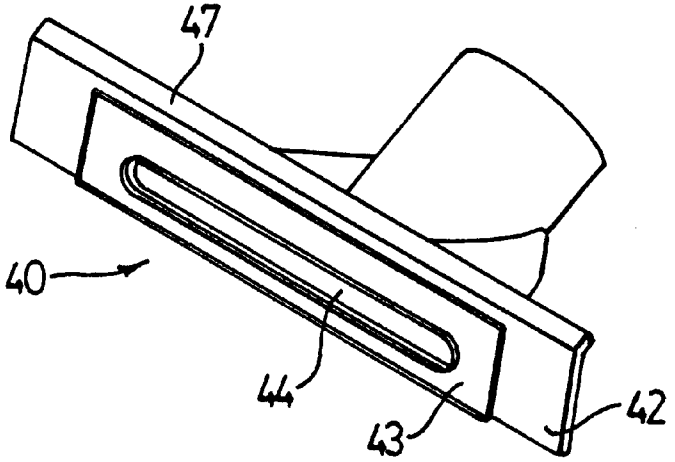
FIG. 18 is an upper perspective view of the coupling of FIGS. 15, 16 and 17.
Figure 17:
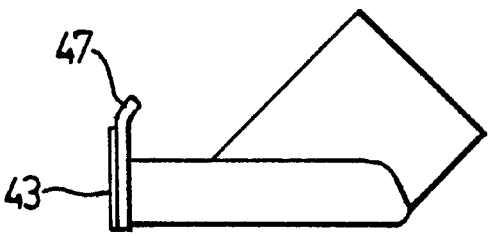
FIG. 17 is a side view of FIG. 16.
Figure 15:
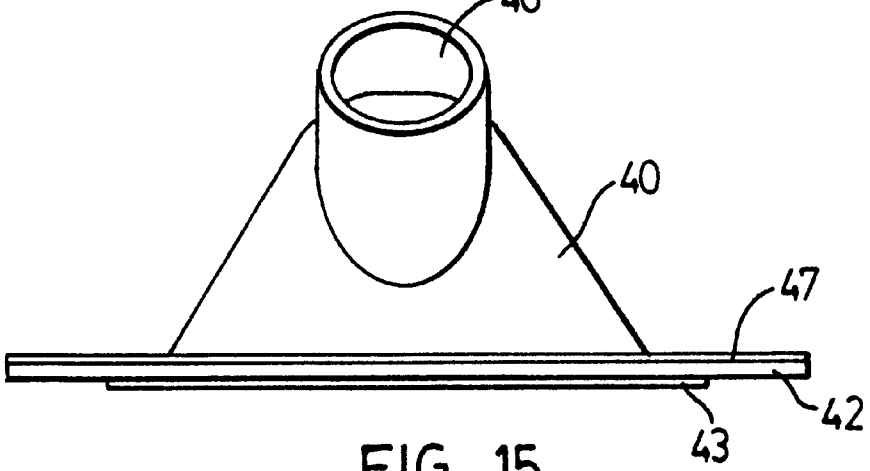
FIG. 15 is a top view of the coupling of FIG. 14.
Figure 16:
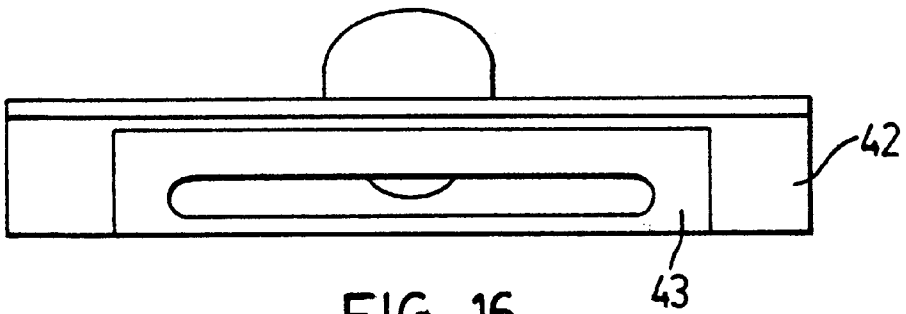
FIG. 16 is a front view of FIG. 15.

In FIG. 14 a hose coupling 40 is positioned against the front face of the front plate 22 of a receptacle 4 with the door 26 in an open position. A hose 41 is connected outwardly from the coupling 40.

In FIGS. 15, 16, 17 and 18 the coupling 40 is shown in greater detail. The coupling 40 has a coupling plate 42 and gasket 43 that lies over the suction inlet portion 16*a* of the opening 16 in the face plate 22 of the receptacle 4. An opening 44 in the coupling plate 42 transforms from a generally rectangular form at the coupling plate 42 to a circular opening 46 at the hose coupling end.

The top edge of the coupling plate 42 preferably carries a small bevelled flange 47 that engages the inner side of the door 26 on the receptacle along the closure plate portion 27. The lower edge of the plate 42 is seated at the ramp 25.

The result of this arrangement is that with the door 26 open and the closure plate portion 27 angled downwardly, the flange 47 on the coupling plate 42 jams the coupling 40 in place with sufficient firmness that, upon starting the vacuum source 1*a*, the coupling 40 is drawn into a tight sealing engagement against the receptacle's suction inlet portion 16*a*. This provides a convenient conversion of the sweeping suction inlet into a coupling source for a standard vacuum hose. It also provides a form of attachment that will allow the coupling to break-away from the vacuum receptacle if excessive force is applied to the coupling by pulling on the wand. This break-away feature allows a disconnection to occur with reduced risk of breakage.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

What is claimed is:

1. A floor-mountable waste receptacle for a suction-based vacuum cleaning system, said receptacle comprising:

(1) a waste transfer chamber with an outlet for coupling to a vacuum source and a vacuum suction inlet;

(2) a sealing outer door having an opened position and a closed position mounted on said chamber for closing the vacuum suction inlet; and (3) an electrical switch assembly, including a switch for activating said vacuum source and an activation flange, said activation flange extending along the length of the door;

wherein said activation flange is carried by the door itself.

2. The invention as in claim 1 in combination with a coupling means to convert the vacuum suction inlet to a circular orifice that is angled upwards to engage with a flexible vacuum hose.

3. The invention as in claim 2 wherein the coupling means engages with, and seals against, the vacuum suction inlet by being contained between:

(1) the lower boundary of the vacuum suction inlet; and (2) the door in its opened position.

4. The invention as in claim 3, said receptacle further comprising a waste receiving ramp extending along a lower edge of the vacuum suction inlet wherein said ramp receives a lower side of the coupling means.

5. The invention of claim 1, said receptacle further comprising a waste receiving ramp extending along a lower edge of the vacuum suction inlet and extending toward said waste transfer chamber.

6. The invention of claim 5, wherein a portion of said ramp adjacent to said vacuum suction inlet has a concave curvature relative to said vacuum suction inlet.

7. A floor mountable waste receptacle for a suction-based vacuum cleaning system, said receptacle comprising:

a waste transfer chamber with an outlet for coupling to a vacuum source and a vacuum suction inlet;

a sealing outer door having an opened position and a closed position mounted on said chamber for closing the vacuum suction inlet;

an electrical switch assembly, including a switch for energizing said vacuum source, and an activation flange operatively coupled to said switch, said activation flange extending along said door;

whereby the use of said activation flange activates said switch and turns on the vacuum source.

8. A invention as in claim 7, said receptacle further comprising a waste receiving ramp extending along a lower edge of said vacuum suction inlet, and extending toward said waste transfer chamber.

9. The invention of claim 8, wherein a portion of said ramp adjacent to said vacuum suction inlet has a concave curvature relative to said vacuum suction inlet.

10. The invention of claim 7, in combination with a coupling means to convert the vacuum suction inlet to a circular orifice that is sized, shaped and positioned to engage with a flexible vacuum hose.

11. The invention of claim 10 wherein the coupling means engages with, and seals against, the vacuum suction inlet by being contained between:

the lower boundary of the vacuum suction inlet; and the door in its opened position.

12. The invention of claim 11, said receptacle further comprising a waste receiving ramp extending along a lower edge of the vacuum suction inlet, and extending toward said waste transfer chamber, which ramp receives a lower side of the coupling means.

13. The invention of claim 12, wherein a portion of said ramp adjacent to said vacuum suction inlet has a concave curvature relative to said vacuum suction inlet.

14. A floor mountable waste receptacle for a suction-based vacuum cleaning system, said receptacle comprising:

a waste transfer chamber with an outlet for coupling to a vacuum source and a vacuum suction inlet;

a sealing outer door having an opened position and a closed position mounted on said chamber for closing the vacuum suction inlet;

an electrical switch assembly, including a switch for activating said vacuum source, and an activation flange extending along said door for use in opening said door;

wherein the opening of said door activates said switch which energizes said vacuum source.

15. The invention of claim 14, said receptacle further comprising a waste receiving ramp extending along a lower edge of said vacuum suction inlet, and extending toward said waste transfer chamber, wherein a portion of said ramp adjacent to said vacuum suction inlet has a concave curvature relative to said vacuum suction inlet.

* * * * *